US007588320B2

(12) United States Patent
Lee et al.

(10) Patent No.: US 7,588,320 B2
(45) Date of Patent: Sep. 15, 2009

(54) DROPLET EJECTION DEVICE AND METHOD USING ELECTROSTATIC FIELD

(75) Inventors: Suk-Han Lee, Suwon-si (KR); Han-Seo Ko, Suwon-si (KR); Do-Young Byun, Seoul (KR); Sang-Joon Han, Suwon-si (KR); Yong-Jae Kim, Suwon-si (KR); Sang-Uk Son, Suwon-si (KR); Jung-Taek Oh, Suwon-si (JP); Ji-Hye Yang, Seoul (KR)

(73) Assignee: In-G Co., Ltd., Suwon (KR)

( * ) Notice: Subject to any disclaimer, the term of this patent is extended or adjusted under 35 U.S.C. 154(b) by 219 days.

(21) Appl. No.: 11/260,689

(22) Filed: Oct. 28, 2005

(65) Prior Publication Data

US 2007/0097177 A1 May 3, 2007

(51) Int. Cl.
*B41J 2/06* (2006.01)

(52) U.S. Cl. ..... 347/55; 347/63; 347/54; 347/9

(58) Field of Classification Search ..... 347/55, 347/74–77, 47, 63, 5, 9, 12
See application file for complete search history.

(56) References Cited

U.S. PATENT DOCUMENTS 5,144,340 A * 9/1992 Hotomi et al. ..... 347/55
2004/0145632 A1* 7/2004 Lee et al. ..... 347/55

* cited by examiner

*Primary Examiner*—Matthew Luu
*Assistant Examiner*—Henok Legesse
(74) *Attorney, Agent, or Firm*—Foley & Lardner LLP

(57) ABSTRACT

Disclosed are a droplet ejection device and method using an electrostatic field. The droplet ejection method includes: setting a separate electric field direction in each of a plurality of nozzles; supplying one of ink and ink containing particles to each nozzle; and forming and ejecting a plurality of separate ink droplets. The droplet ejection device includes a deposition part having electrode layers and insulating layers deposited toward a nozzle. Therefore, it is possible to readily perform droplet ejection without a heater or diaphragm vibration device. In addition, it is possible to reduce impact applied to the ink and obtain good print quality, since the ink is ejected using the electrostatic field.

4 Claims, 8 Drawing Sheets

Fig 7

Calculate estimation value by simplifying using RC serial equivalent circuit $$\frac{1V}{(+17V)-(-17V)} \cong 0.03 = e^{-\frac{1}{RC}t}$$

$$R = \frac{l}{\sigma A} \qquad C = \varepsilon \frac{S}{d}$$

$\sigma^{-1} = 2.3 \times 10^{-3}$
$A = 1(\mu m)^2$
$l = 1.0mm$ $\varepsilon = 4 \times 8.854 \times 10^{-12}$
$S = 5000 \cdot 2000(\mu m)^2$
$d = 1\mu m$

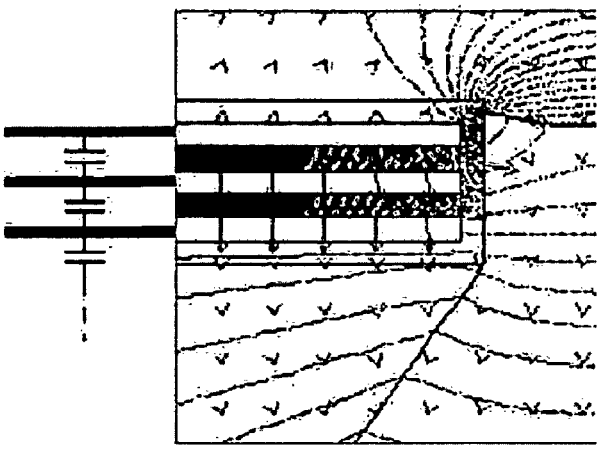

$$t \cong 3.5RC \cong 0.285\mu sec$$

Voltage drive control frequency : Estimate the frequency less than about 3.5MHz

DROPLET EJECTION DEVICE AND METHOD USING ELECTROSTATIC FIELD

BACKGROUND OF THE INVENTION

1. Field of the invention

The present invention relates to a droplet ejection device and method using an electrostatic field, and more particularly, to a droplet ejection device and method for generating a specific electric field at a surface of ink adjacent to a nozzle to eject the ink.

2. Description of the Prior Art

A conventional droplet ejection device used in an inkjet printer has a structure that ejects ink using a heater or diaphragm vibration device installed at an inkjet head.

Hereinafter, an example of the inkjet printer using the heater will be briefly described.

First, when current flows through an electrode installed at the heater, heat is generated from the heater, and the heat is sequentially conducted to a protection layer into which the ink is absorbed. When the ink is heated by the conducted heat to generate bubbles, a volume of an upper part of the ink is varied due to the bubbles so that the upper part of the ink is pushed out through an opening formed at a nozzle plate.

As a result, the ink expanded and discharged to the exterior of the nozzle plate is ejected on paper in a droplet shape due to surface tension.

However, such a conventional droplet ejection device has problems of generating a thermal change in the ink due to the heating process for generating bubbles, and degrading print quality due to sudden internal volume variations.

SUMMARY OF THE INVENTION

Therefore, the present invention has been made in view of the above-mentioned problems, and it is an object of the present invention to provide a droplet ejection device and method capable of upgrading print quality by enabling a new concept of flow control using an electrostatic field.

In order to accomplish the above object, there is provided a method of ejecting ink using an electrostatic field including: setting an electric field direction toward a discharge port of the nozzle, supplying ink or ink containing particles to a nozzle, and forming and ejecting an ink droplet.

In addition, a droplet ejection device including a nozzle in accordance with the present invention includes a deposition part having electrode layers and insulating layers, which are deposited toward the nozzle.

Preferably, each of the deposited electrode layers is connected to a separated power source to adjust the direction of an electric filed.

In addition, preferably, the formation of the droplet is controlled through a coating part continuously composed of a hydrophilic material and a hydrophobic material in the nozzle.

In addition, the formation and ejection of the droplet may be controlled by adjusting the magnitude of a voltage applied to the separate power source in a time-based manner.

Meanwhile, another method of ejecting ink using an electrostatic field in accordance with the present invention includes: setting a separate electric field direction in each of a plurality of nozzles, supplying ink or ink containing particles to the plurality of nozzles, and forming and ejecting a plurality of separate droplets.

BRIEF DESCRIPTION OF THE DRAWINGS

The foregoing and other objects, features and advantages of the present invention will become more apparent from the following detailed description when taken in conjunction with the accompanying drawings in which:

FIG. 7 is a conceptual view showing a process of calculating and estimating a minimum allowable time of an adjustment period when a voltage applied to a nozzle of a droplet ejection device in accordance with the present invention is adjusted.

DETAILED DESCRIPTION OF THE PREFERRED EMBODIMENTS

Hereinafter, an exemplary embodiment of the present invention will be described in conjunction with the accompanying drawings.

Figure 1:
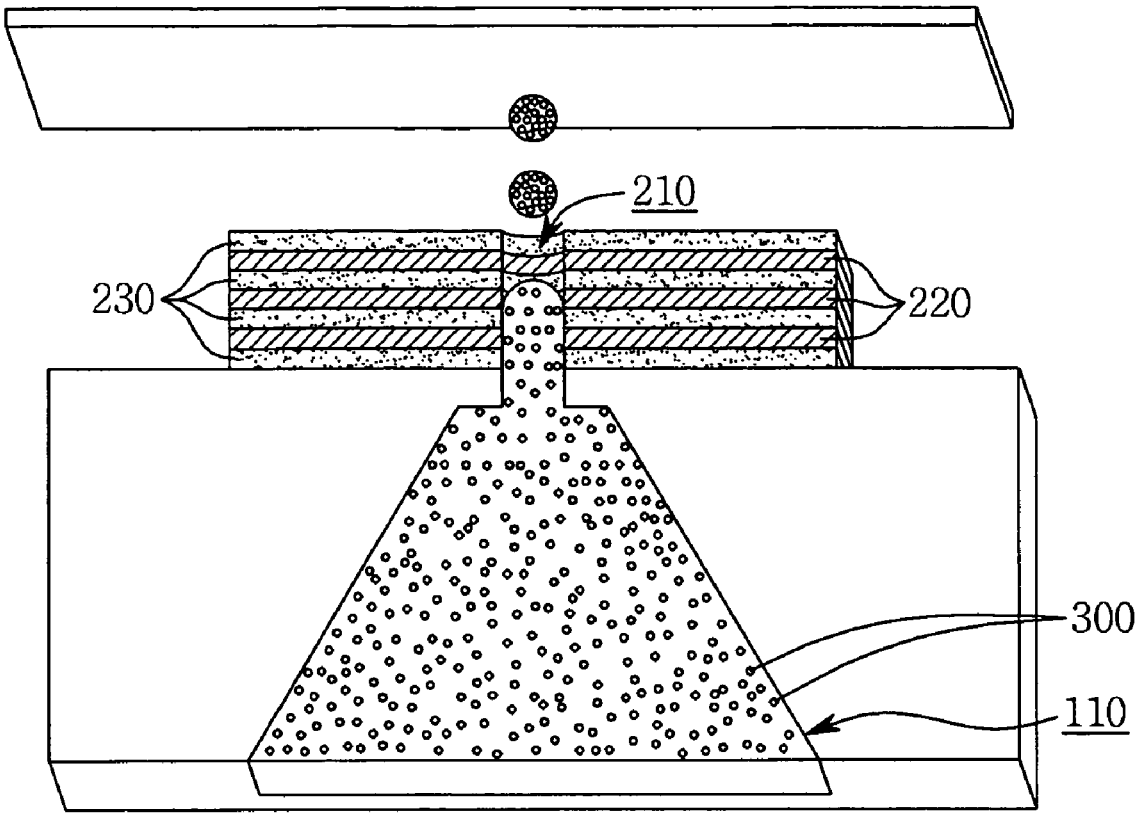
FIG. 1 is a front cross-sectional view of the structure of a droplet ejection device using an electrostatic field in accordance with the present invention.

FIG. 1 illustrates a droplet ejection device using an electrostatic field in accordance with the present invention.

As shown in FIG. 1, the droplet ejection device using an electrostatic field in accordance with the present invention includes a chamber 110 for storing ink 300, and a print head having a nozzle 210 formed at the chamber 110.

In addition, a deposition part having electrode layers 220 and insulting layers 230, which are alternately deposited around the nozzle 210, is installed in a direction extending from the nozzle 210. The electrode layer 220 may be formed of aluminum and so on, and the insulating layer 230 may be formed of $Si_3N_4$ and so on.

Further, each of the electrode layers 220 is connected to a separate power source, thereby setting the voltage magnitude according to a predetermined control signal and adjusting an electric field direction around the nozzle 210 within a predetermined range.

Figure 6:
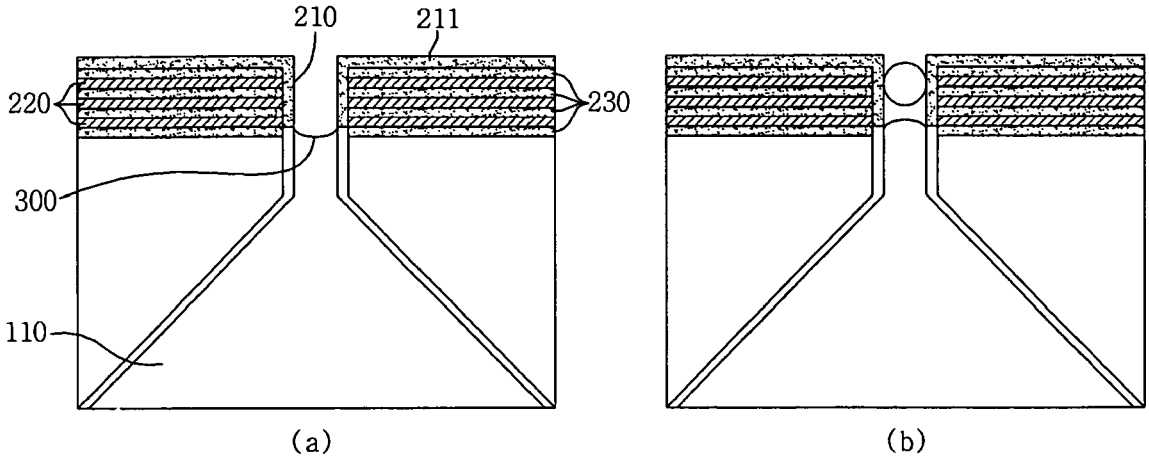
FIG. 6 is a view illustrating a coating part and a droplet ejection state of an inner surface of a nozzle in FIG. 1, (a) of which is before supplying a voltage and (b) of which is after supplying the voltage.

As shown in FIG. 6, a coating part 211 continuously composed of a hydrophilic material and a hydrophobic material may be applied to an inner surface of the nozzle 210. The hydrophilic material may be formed of SiO2, and the hydrophobic material may be formed of Teflon, silicon or the like. Therefore, it is possible to control the formation of droplets using instability on the transition from hydrophilicity to hydrophobicity. In this instable state, an external electric filed applies repulsive force to meniscus (a concave surface of the ink surface) to take a droplet away.

Figure 4:
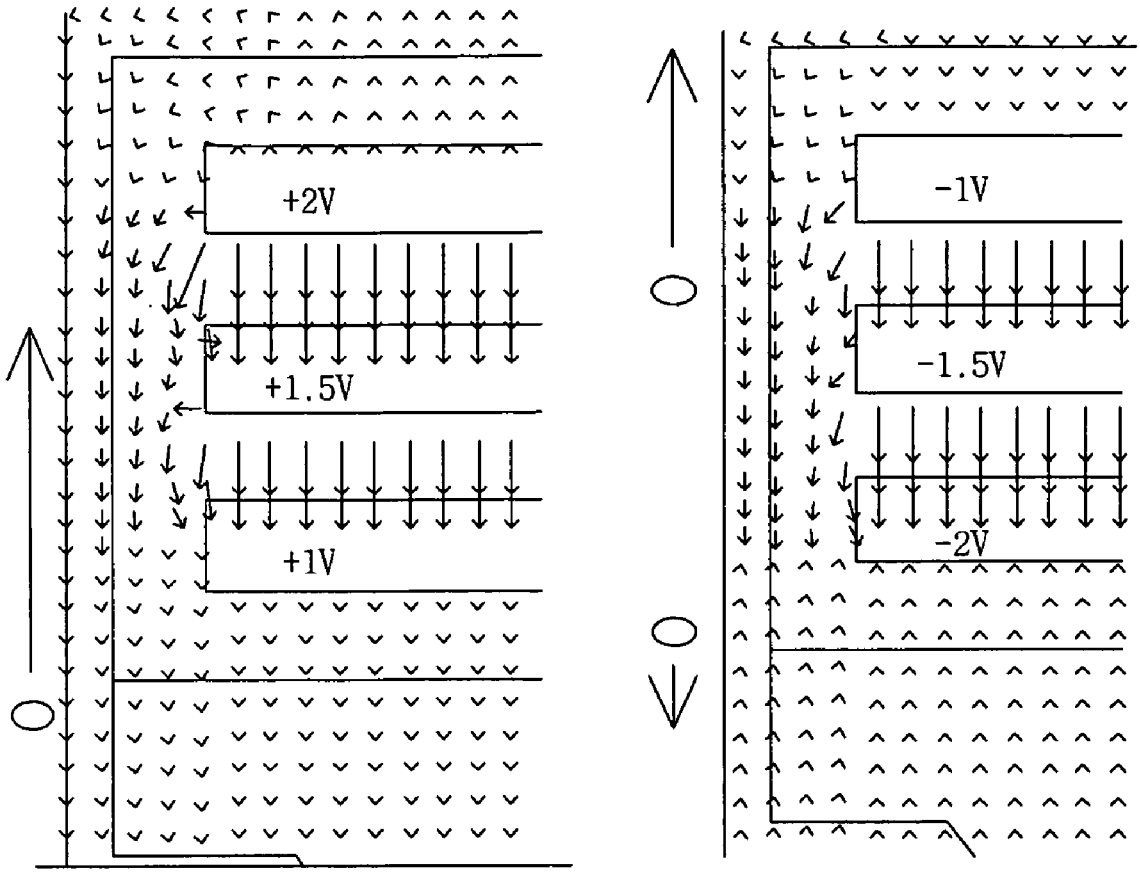
FIG. 4 is a conceptual view showing the theory that an electrostatic field is formed in accordance with the present invention.

Meanwhile, as shown in FIG. 4, each of the deposited electrode layers 220 is connected to the separate power source having a voltage that becomes larger toward a discharge port of the nozzle 210.

Hereinafter, operation and theory of the present invention will be described.

Briefly describing, the present invention is character in that fluid can be smoothly discharged by applying different voltages to electrodes deposited around a nozzle in a state that general ink or nano fluid having charges is contained in a chamber.

Figure 2:
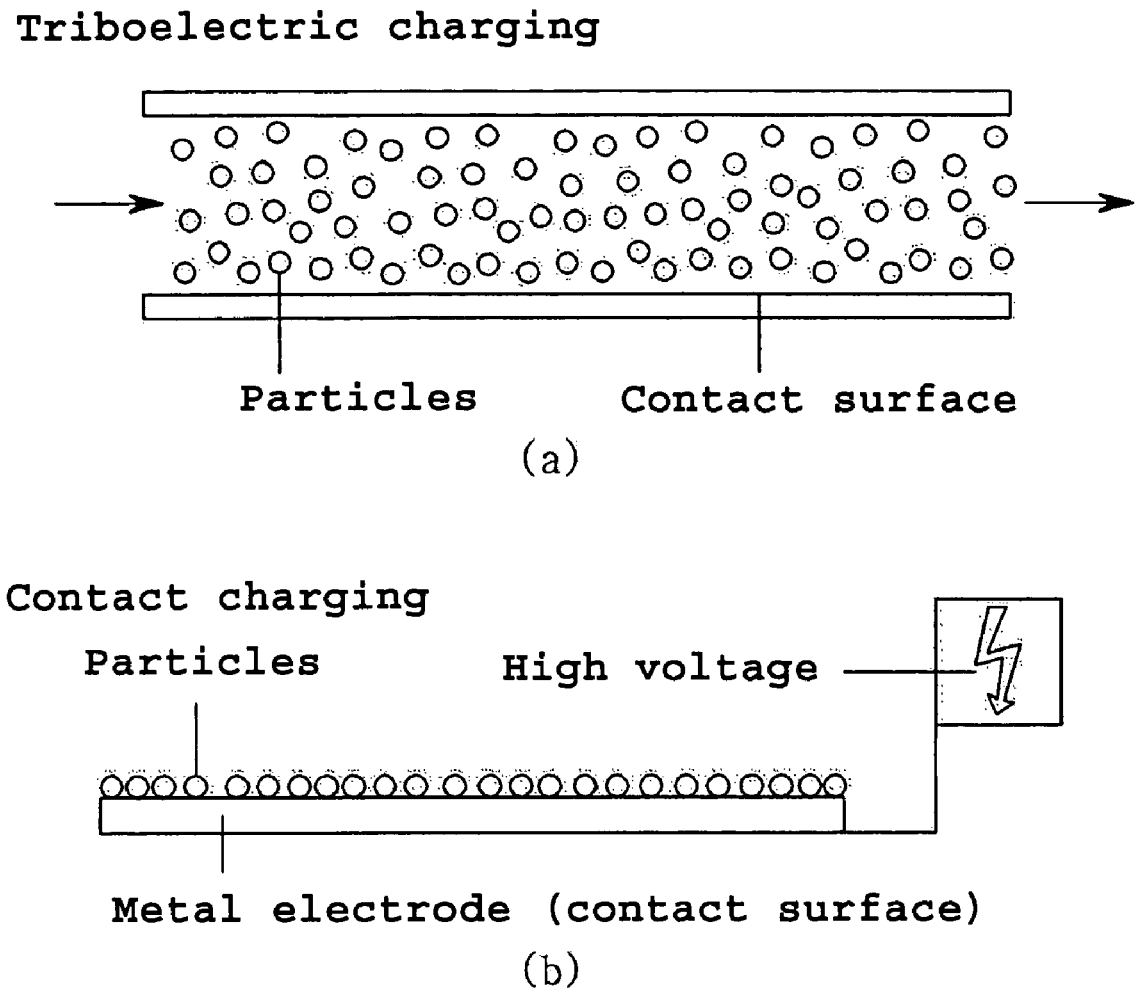
FIG. 2 is a conceptual view showing the theory that particles have charges.

In particular, when the nano fluid has charges, as shown in FIG. 2, the charges can be charged by triboelectric charging or contact charging, which are briefly described hereinafter.

1) Triboelectric Charging (see FIG. 2*a*)

When electric neutral insulating bodies having different electrostatic properties are in contact with each other, charges are transmitted from one surface to the other surface in order to obtain thermodynamic equilibrium (i.e., to reduce a chemical potential difference). At this time, when the surfaces are rapidly separated from each other due to sliding or rubbing, excessive charges remain on the surfaces. Particles are charged by a collision with a rotating agitator used to disperse powder. Therefore, when the triboelectric charging is performed in liquid nitrogen, the charging and powder dispersion can be simultaneously performed using a high shear agitating system.

2) Contact Charging (see FIG. 2*b*)

Floating matters are spouted out through a grid-shaped metal electrode connected to a high voltage supplier, and charges are transmitted from the electrode to particles due to a potential difference at this time.

As a result of researches, it is appreciated that the triboelectric charging is effective to charge more surface charges than the contact charging.

Figure 3:
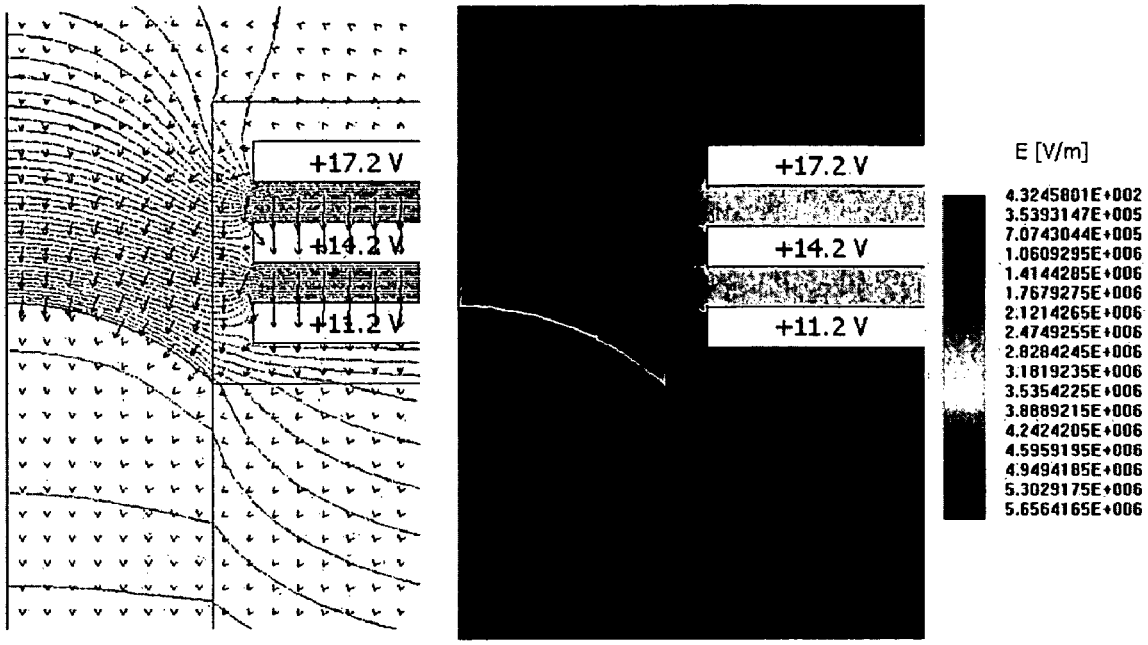
FIG. 3 is a view showing an electric field formed around an ink surface in accordance with an embodiment of the present invention.

Hereinafter, a process of ejecting ink from a nozzle will be described with reference to FIGS. 3 and 4.

An electric field formed around the nozzle varies depending on arrangement of drive electrodes and magnitude of voltage, and the magnitude and direction of electrostatic force also vary depending on positions of fluid and shapes of a fluid surface. Therefore, first, in consideration of basic arrangement of the electrodes of the nozzle, an appropriate model was selected.

The model has a structure that a bottom surface of a chamber is a reference potential, and three electrodes are deposited around the nozzle in a certain interval to adjust voltage of each electrode. At this time, the magnitude and direction of the electrostatic field are determined at a center of a nozzle inlet depending on voltages applied to the electrodes. As shown in FIG. 3, when charges of nano particles distributed in the fluid are negative, an upper electrode should have a thickness larger than a lower electrode since the direction of the electrostatic field should be oriented inside the chamber located at a lower side with reference to the nozzle inlet in order to induce conveyance of particles to the exterior of the nozzle.

In this process, a main region for moving the fluid is located under the fluid surface and has an electric field smaller than that of an air region of the exterior of the nozzle due to mediun properties of the fluid. In particular, a large electric field formed outside the fluid surface as shown in FIG. 3 does not perform a great role to move the fluid.

FIG. 4 illustrates an electric field affecting the fluid when various magnitudes of voltages applied to electrodes around the nozzle inlet.

FIG. 4*a* shows a typical voltage condition that the fluid flows from inside the chamber toward the discharge port. In particular, the electric field at the discharge port of the nozzle has a large magnitude to apply more pressure to the fluid.

FIG. 4*b* shows the case when a direction of the electric field is reversed by 180° by applying negative voltages to all three electrodes. Here, the upper electrode has a negative voltage smaller than that of the lower electrode so that a small part of the fluid pulled up to a surface of the discharge port is separated from the fluid to be ejected to the air.

Figure 5:
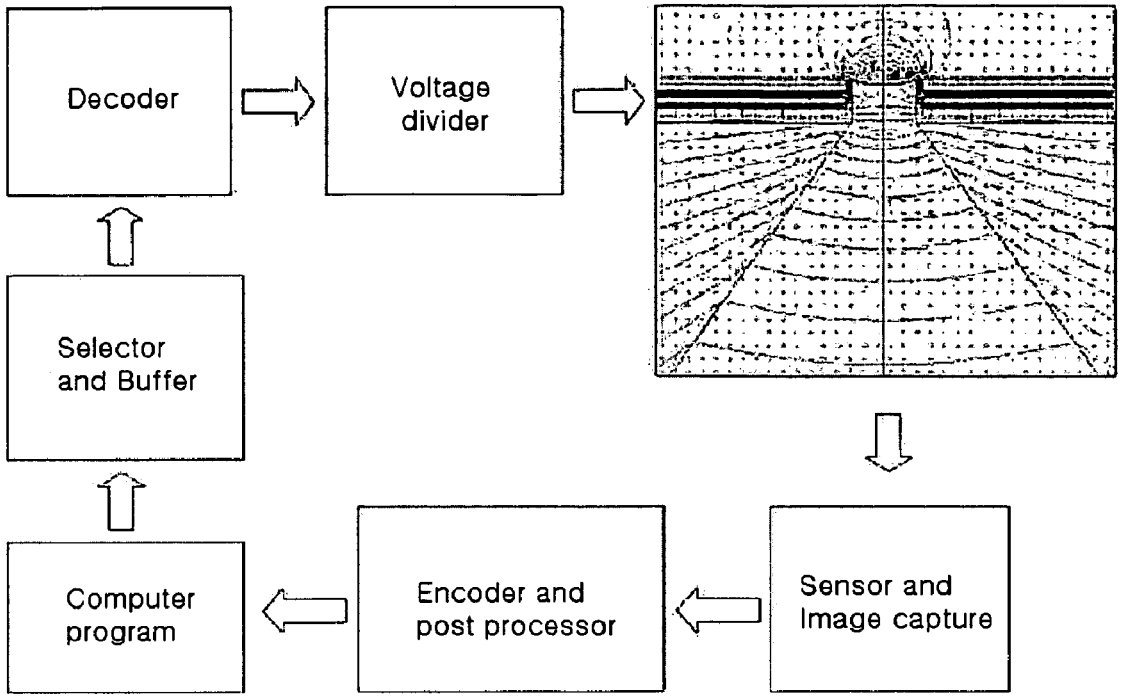
FIG. 5 is a conceptual view showing the theory that a voltage applied to a nozzle of a droplet ejection device in accordance with the present invention is adjusted.
Figure 8:
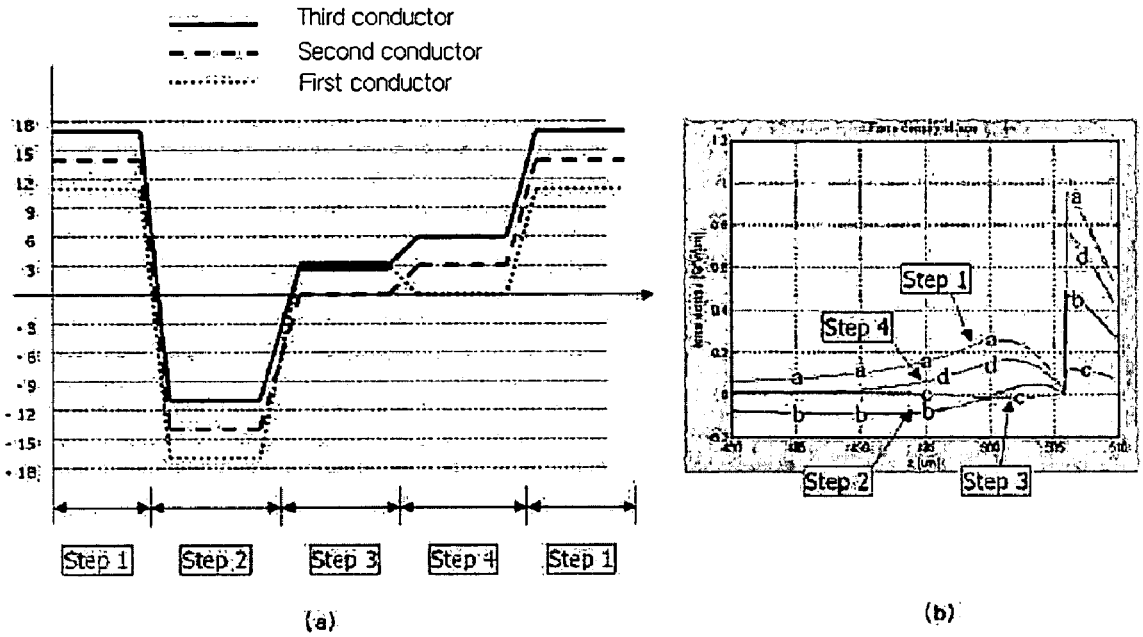
FIG. 8 is a diagram showing a relationship of time and adjusted magnitudes of voltages applied to a nozzle of a droplet ejection device in order to induce droplet ejection in accordance with the present invention.

The electrodes are operated using the above two typical methods as a basic control process to thereby smoothly induce formation and ejection of the ink droplet Meanwhile, FIGS. 5, 7 and 8 illustrate a theory that the voltages applied to the separated voltage sources are adjusted in a time-based manner to control formation and rejection of the ink droplet, which will be briefly described hereinafter.

FIG. 5 illustrates an example of a device adapted to adjust the voltages in accordance with the present invention.

Basically, the voltages are automatically controlled by a computer program. As shown in FIG. 4, since the ink droplet is instantly conveyed and ejected, it is necessary to test and develop a device for controlling the ejection, to use a commercially available computer to adapt an application system, and to employ a microprocessor for mass production.

First, all processes are programmed using the computer, and a voltage of each separate voltage device is set through an external interface using a selector, a buffer and a decoder in a digital manner. After setting the voltages of the voltage device, the voltages are simultaneously applied to the deposited electrodes.

The above process may be performed by a single order parameter of a main program in a bundle, and adjustment and setting time of each separate voltage may be changed as a selectivity factor of the order parameter, thereby more freely and actively adjusting each of the separate power sources.

In addition, in order to confirm the operated result and find the optimal setting condition, a device for high-speed photographing an ejection operation of the nozzle and feed-backing the operation to the computer may be adapted. At this time, while a high speed photographing device may be used for a test, the device may be implemented through a sensor in the case of adapting to a real application device.

In this process, it is required to estimate a minimum continuous time of voltage adjustment available in the nozzle structure in accordance with the present invention, as shown in FIG. 7.

First, the deposited electrodes can be simulated using capacitance of a basic circuit device, and the simulated value is calculated according to a well-known equation of capacitance. In addition, after calculating using a well-known equation of resistance according to a conductor structure from the exterior of the nozzle to the electrode, a time constant according to a ratio of voltage differences applied in the simulation is calculated to obtain a voltage increase or drop delay time generated when the voltage differences are generated.

According to the result, when the delay time is about 0.285 μsec, and a time for maintaining the voltage setting is sufficiently large, the voltage may be readily adjusted.

In addition, a voltage adjustment frequency less than about 3.5 MHz is estimated, which is a sufficiently large frequency in comparison with a flow phase of the ink.

FIG. 8 illustrates an example that voltages applied to the separate power sources are varied through a plurality of steps in order to variously change the direction and magnitude of an electric field as shown in FIG. 4, according to theoretical and programmed implementation illustrated in FIGS. 5 and 7.

The deposited electrodes of the nozzle in accordance with the present invention have a triple layered structure, and each of the three electrodes basically sets a voltage wave in each step. The fluid surface is transported to the inlet port (Step 1), the fluid is divided into small droplets (Step 2), and the droplet is instantly ejected and the varied fluid surface is returned to the state of Step 1 (Steps 3 and 4).

FIG. 8*b* illustrates that distribution of the electrostatic force applied to a center of the nozzle inlet is varied according each step.

Meanwhile, the present invention is capable of adapting an array-type droplet ejection method. For example, a plurality of nozzles have separate electric field directions oriented therein to supply ink or ink containing particles to each nozzle, thereby forming and ejecting a plurality of separate ink droplets.

As can be seen from the foregoing, the present invention has an advantage of readily performing droplet ejection without a heater or diaphragm vibration device.

In addition, it is possible to reduce impact applied to the ink and obtain good print quality, since the ink is ejected using the electrostatic field.

While this invention has been described in connection with what is presently considered to be the most practical and preferred embodiment, it is to be understood that the invention is not limited to the disclosed embodiment and the drawings, but, on the contrary, it is intended to cover various modifications and variations within the spirit and scope of the appended claims.

What is claimed is:

1. A method of ejecting ink using an electrostatic field, the method comprising:

applying substantially simultaneously at least two different voltage levels from each of at least two separate power sources to each of at least two different electrode layers respectively that surround at least a part of the circumference of a nozzle, wherein a magnitude of the applied voltage levels supplied to each of the at least two electrode layers increases toward a discharge port of the nozzle, and wherein an insulating layer surrounding at least a part of the circumference of the nozzle is provided between each of the at least two electrode layers, the insulating layer substantially filling the volume between each of the at least two electrode layers;

supplying ink or ink containing particles to the nozzle;

forming a single ink droplet; and ejecting the single ink droplet through the discharge port of the nozzle.

2. The method according to claim 1, wherein the magnitude of the applied voltage levels is adjusted based on time.

3. A method of setting separate electric field directions in a plurality of nozzles, wherein setting the separate electric field directions in each of the plurality of nozzles comprises:

applying substantially simultaneously at least two different voltage levels from each of at least two separate power sources to each of at least two different electrode layers respectively that surround at least a part of the circumference of a nozzle, wherein a magnitude of the applied voltage levels supplied to each of the at least two electrode layers increases toward a discharge port of the nozzle, and wherein an insulating layer surrounding at least a part of the circumference of the nozzle is provided between each of the at least two electrode layers, the insulating layer substantially filling the volume between each of the at least two electrode layers;

supplying ink or ink containing particles to each of the nozzles;

forming a plurality of separate droplets; and ejecting the plurality of separate droplets.

4. An ink ejection device using an electrostatic field, the ink ejection device comprising:

an ink ejection nozzle;

at least two electrode layers surrounding at least a part of the circumference of the ink ejection nozzle;

at least one insulating layer surrounding at least a part of the circumference of the ink ejection nozzle, the at least one insulating layer substantially filling the volume between each of the at least two electrode layers; and at least two power sources, the at least two power sources coupled to the at least two electrode layers, wherein the at least two power sources are configured to substantially simultaneously provide different voltages to the at least two electrode layers, wherein the magnitude of the voltages provided to the at least two electrode layers increases toward a discharge port of the ink ejection nozzle.

* * * * *